United States Patent [19]

Pohl

[11] Patent Number: 5,045,090

[45] Date of Patent: Sep. 3, 1991

[54] PROCESS AND DEVICE FOR RECLAIMING USED FOUNDRY SANDS

[75] Inventor: Peter Pohl, Rehburg-Loccum, Fed. Rep. of Germany

[73] Assignee: Pohl Giesserreitechnik, Fed. Rep. of Germany

[21] Appl. No.: 354,841

[22] Filed: May 22, 1989

[30] Foreign Application Priority Data

May 26, 1988 [EP] European Pat. Off. ..... 88108436.2

[51] Int. Cl.[5] ..... B24B 15/00

[52] U.S. Cl. ..... 51/26; 241/57; 241/DIG. 10; 134/2

[58] Field of Search ..... 134/2, 174, 32, 33, 134/17, 39, 25.1, 10, 13.4, 3, 109, 111, 26, 27, 28, 30; 209/155; 106/38.9, 482; 164/5, 271, 423; 423/340; 51/26; 241/DIG. 10, 47, 57, 98

[56] References Cited

U.S. PATENT DOCUMENTS 4,144,088 3/1979 Adams ..... 134/2
4,205,796 6/1980 Evans ..... 241/DIG. 10
4,811,909 3/1989 Inoki ..... 241/57

FOREIGN PATENT DOCUMENTS 265707 10/1987 European Pat. Off. .
3103030 5/1984 Fed. Rep. of Germany .
3400656 7/1985 Fed. Rep. of Germany .

*Primary Examiner*—M. Rachuba
*Attorney, Agent, or Firm*—Laubscher, Presta and Laubscher

[57] ABSTRACT

The invention relates to a process and a device for reclaiming used foundry sands. In the process according to the invention the used sands are free from carbon-containing materials in a first step by means of a thermal treatment, inasmuch as they contain organic, carbon-containing material, and are subsequently mechanically cleaned batch-wise, for which purpose wear-resistant friction elements are moved through the sand charge as a function of the degree of oolitization of the respective sand batch at such a speed that the said grain of the batch is not destroyed. The device according to the invention consists of a cylindrical housing, in which rotatingly driven friction elements are provided, means for the batch-wise filling of the receptacle with used sand and means for discharge cleaned sand from the receptacle being provided. The drive of the friction elements is effected as a function of the degree of oolitization of the used sand and in such fashion that the quartz grain of the sand batch is not destroyted.

6 Claims, 4 Drawing Sheets

RECLAIMING OF ALPHA-BETA-SET AND $CO_2$-USED SANDS
PRECLEANING OF CLAYBOUND USED SANDS

RECLAIMING OF RESINBOUND USED SANDS AND OF CLAYBOUND USED SANDS

PROCESS AND DEVICE FOR RECLAIMING USED FOUNDRY SANDS

BACKGROUND OF THE INVENTION

The invention relates to a process for reclaiming used foundry sands, in which the used sands, if required, are freed from all adhering carbon-containing materials in a first step by a thermal treatment at 500° to 900° C. and subjected subsequently to a mechanical cleaning treatment. A process of the genus is already known from DE-OS 34 00 656.

In this known process, which is a continuous process, a reclaiming of used sands is carried out in three successive steps, namely a mechanical precleaning, a thermal treatment of the precleaned sand and a mechanical postcleaning. In this process the mechanical postcleaning is carried out after the carrying out of the thermal treatment in a rotating, cylindrical drum, in which baffles and/or grinding bodies such as balls or the like are provided.

This known mechanical postcleaning is detrimental inasmuch as the use of a rotating drum with baffles does not lead to a sufficient grain-to-grain friction to remove binding agent residues (bentonite) adhering to the sand grain. If the known mechanical cleaning process is carried out by means of grinding bodies a great portion of sand grains is destroyed. Since the known process takes place continuously, the known process cannot be adapted individually to different degrees of impurities of different used foundry sands. As a result it is not possible by means of the known process to claim used sands to new sand quality.

It is already known to accelerate used sands continuously by means of compressed air in a pipe and to hurl them against a baffle plate. Sand speeds of more than 20 m/s are used here, whereby up to 25% of the treated sand are smashed.

It is also already known to continuously subject used sands to a wet reclaiming, the used sand being treated with water so that carbon and clay particles are separated by the movement of the sand in the water. The disposal product is a moist sludge which contains up to 50% of hydrocarbons. The disposal of the washing water is problematical in this process for reasons of environmental protection and moreover the further use of the resultant disposal product is not ensured.

In this connection reference is made to the fact that the Waste Disposal Act having come into force in the Federal Republic of Germany in 1987 requires that used foundry sands are to be reclaimed and again supplied to the production process, because the former practice of depositing used sands on waste dumps will no longer be admissible in future.

The measures suggested so far for the reclaiming of used foundry sands failed in the last analysis because either the environment was inadmissibly burdened or because it was not possible to sufficiently remove the binding agent burnt onto the sand grain surfaces during the casting process (bentonite in the case of claybonded sands). As already mentioned, the hurling of used sand at high speed against stationary baffle surfaces, which is customary in technology, leads to considerable smashings of quartz sand of up to 25%, which leads to corresponding losses of sand.

Approx. 2.4 million tons of used foundry sands occur as waste products in waste dumps per year in the Federal Republic of Germany. This total amount of sand is divided into approx 30% of sand, which is found with artificial resin bonds and approx. 70% of sand which is found in clay-bonded fashion. The artificial-resin-bonded sands are already partly reclaimed thermally, i.e. the sand is heated to approx. 800° C., the organic, carbon-containing products adhering to the quartz grain being burnt. The clay-bonded sands with bentonite as binding agent are mainly obtained during the so-called wet casting mould systems.

SUMMARY OF THE INVENTION

The invention is based on the object to develop a process of the genus for reclaiming used foundry sands in such fashion that a thorough reclaiming of the used sands to almost new sand quality is possible without any significant sand smashing.

The invention is furthermore based on the object to create a device by means of which used sands which are thermally pretreated, if required, i.e. which are free from organic, carbon-containing substances, can be reliably and carefully cleaned mechanically, i.e. freed from binding agents (bentonite). The so-called used alphaset/betaset sands and the so-called used $CO_2$ sands do not contain any organic, carbon-containing substances and require therefore no thermal pretreatment at 500° to 900° C.

The technical progress which can be obtained by means of the invention results primarily from the fact that the used sand being thermally pretreated, i.e. freed from organic, carbon-containing substances is mechanically supplied batchwise to a friction treatment after a corresponding precooling. This mechanical friction treatment is adapted to the requirements of the respective batch as regards duration of time and intensity and care is moreover taken that the sand grain is not destroyed.

Due to the fact that the process according to the invention provides for a batch-wise mechanical cleaning, the duration of cleaning and the cleaning intensity can be controlled differently batchwise, in each case as a function of the degree of oölitization of the sand.

In the process according to the invention the mechanical cleaning of the used sands is carried out batch-wise in such fashion that wear-resistant friction elements are moved through each sand batch, a relative speed occurring between the sand grains and the friction elements which leads to that burnt on binding agent residues (bentonite) are abraded by the sand grain surface. The speed of the friction tools and thus the aforementioned relative speed are however selected in such fashion that the quartz sand grains are not destroyed.

The technical progress which can be obtained by means of the device according to the invention results from the fact that mechanically driven friction elements are provided in a receptacle designed for batch-wise operation, which are moved through the sand batch.

BRIEF DESCRIPTION OF THE DRAWING

The invention is described in more detail in the following by means of examples of embodiment and with reference to the drawing.

DETAILED DESCRIPTION

Figure 1:
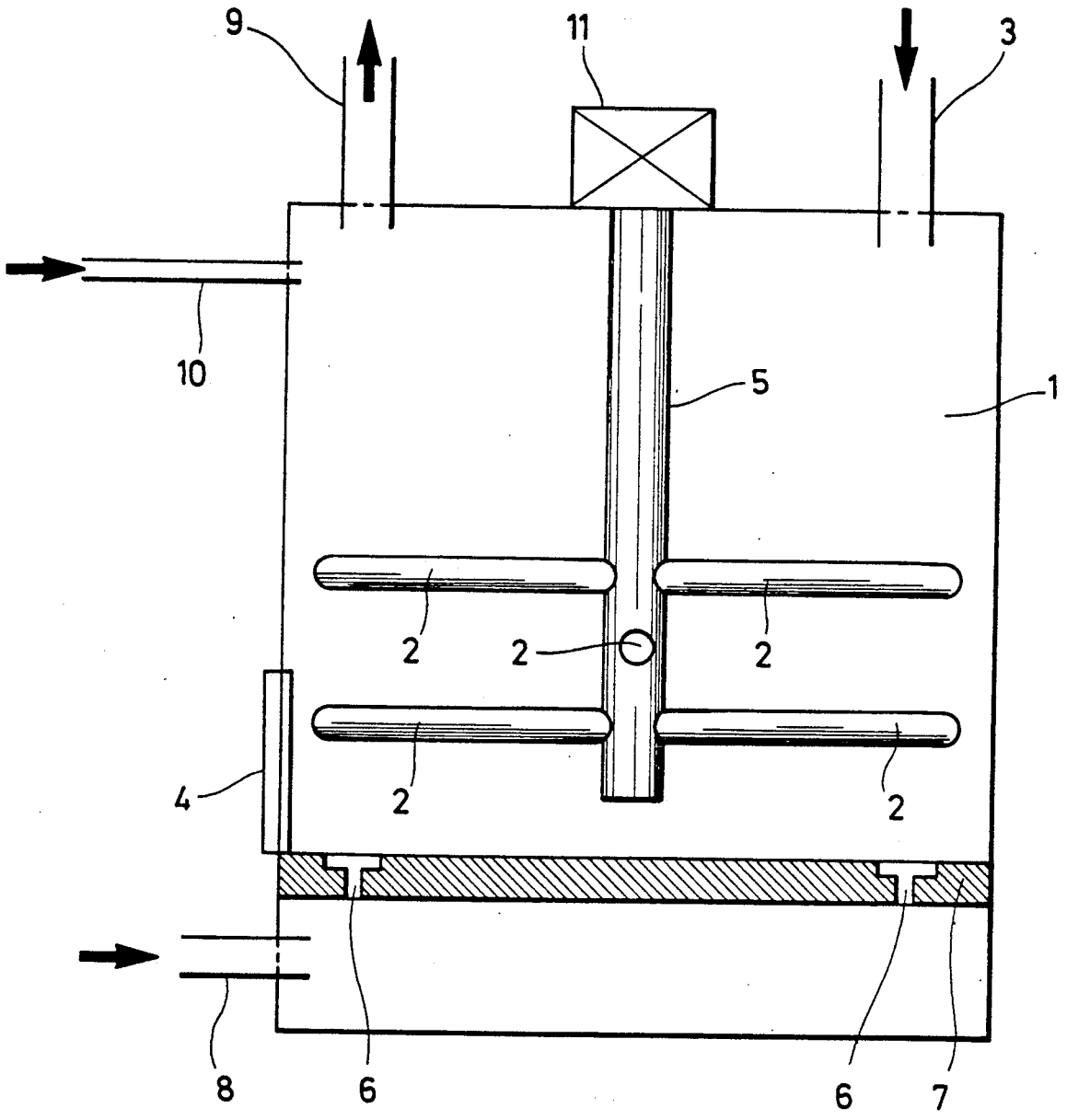
FIGS. 1 to 2 show fundamental representations of two preferred embodiments of the device according to the invention and FIGS. 3 and 4 show schematic representations of application possibilities according to the invention.

The sand to be reclaimed is subjected to a thermal treatment at temperatures of 500° to 900° C. outside the device according to the invention if it contains carbon and/or bentonite, the temperatures being selected in such fashion that a complete disposal of the gases occurring during the burning process is ensured. After the thermal treatment the treated sand must not contain any carbon-containing components, because otherwise the mechanical cleaning step carried out subsequently in the device according to the invention would be impaired.

Used sands thermally treated at approx. 500° to 900° C. are preferably cooled to about 150° to 300° C. prior to the mechanical cleaning to go easy on the mechanical sand cleaning means. It is understood that the so-called used alphaset/betaset sands and the socalled used $CO_2$ sands do not require any thermal treatment at 500° to 900° C.

The sand free from organic-carbon-containing substances, that is to say which was possibly thermally pretreated is introduced into the interior of a cylindrical receptacle 1 by means of a feed means 3. This receptacle has a shaft 5 driven by a driving means such as electric motor 11 in its vertical axis, to which at least one friction element 2 in the form of a stirring arm is fastened. In the embodiment according to FIG. 1, three layers of horizontal stirring arms are provided one on top of the other at the shaft 5, these layers being disposed in relative staggered relationship.

As represented in FIG. 1 the rotational drive may be effected from the top. However, instead of this, the rotational drive may optionally be effected from below. Several shafts provided with friction elements may be provided in the case of larger receptacle dimensions.

Figure 2:
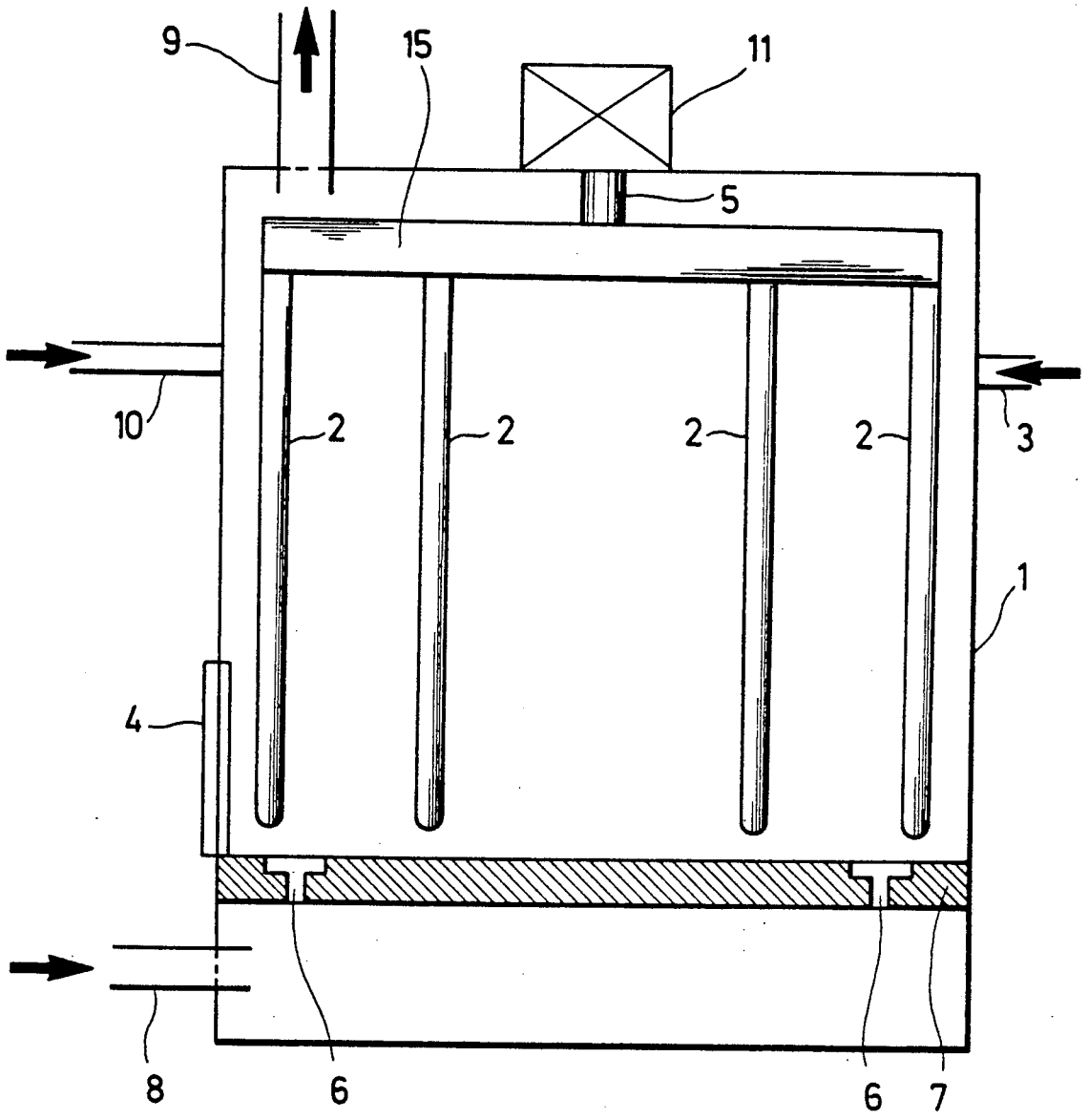

In the embodiment according to FIG. 2 a circular disk 15 rests on the shaft driven by means of the driving means (electric motor) 11, to which a plurality of friction elements 2 extending in parallel to the axis of rotation of the shaft 5 are fastened. These friction elements 2 are fastened at their upper ends to the disk 15 and extend with their lower ends to closely above the nozzle bottom 7 represented in FIGS. 1 and 2. The distance between the nozzle bottom surface and the lower end of the vertically disposed friction elements 2 according to FIG. 2 is approx. 15 mm.

Four vertical friction elements are represented in FIG. 2, the two outer friction elements being disposed in the area of the outer circumference of the disk 15 and the two central vertical frictional elements 2 being disposed approx. between the longitudinal axis of the shaft 5 and the two first-mentioned outer vertical friction elements. Four vertical friction elements 2 are represented in FIG. 2, which are disposed on a diameter of the disk 15. Four further vertical friction elements are preferably disposed on a second diameter of the disk 15, the two diameters provided with the friction elements preferably intersecting each other at a right angle.

The rotational drive of the second embodiment can be effected from above as represented in FIG. 2. However, the rotational drive can, instead of this, be optionally carried out from below. Several shafts provided with friction elements may be provided in the case of greater dimensions of the cylindrical receptacle 1.

With the exception of the friction elements 2, which are designed as horizontal arms in the embodiment according to FIG. 1 and as vertical arms according to the embodiment according to FIG. 2, the two preferred embodiments of the sand cleaning device according to the invention are identical. The following description of the device according to the invention applies consequently to both represented embodiments.

After the introduction of a sand batch by means of the feed means 3, the shaft 5 with the friction elements 2 fastened thereto is rotated. Due to this rotational movement a relative movement takes place between the grains of the sand batch and the rotating friction elements. The sand grains are accelerated by the rotating friction elements due to which a relative speed occurs between the sand grains and the friction elements which causes the cleaning effect of the binding agent (bentonite) burnt onto the sand grains. The duration and the intensity of the rotation of the friction elements 2 is determined as a function of the degree of oolitization of the respectively treated used sand batch.

After the completion of the mechanical sand cleaning the reclaimed batch is discharged through a discharge opening 4 provided in the outer wall of the receptacle 1. All embodiments of the cleaning device according to the invention are preferably provided with a means (not shown) for metering the supplied used sand batch.

The circumferential speed of the friction elements at the outermost circumference should not be less than 5 m/s and not more than 15 m/s. There is no satisfactory cleaning effect at less than 5 m/s and damage of the quartz grain must be feared at more than 15 m/s. The mechanical sand cleaning is preferably carried out in such fashion that in the first embodiment the rotating horizontal arms (friction elements) have a circumferential speed of not more than 15 m/s at their free ends, while the circumferential speed of the horizontal arms in the area of the driving shaft 5 is about 5 m/s. The duration of the cleaning treatment varies depending upon the degree of oolitization, but is 10 minutes per batch as a maximum. In the second embodiment the vertical arms of the outer cirumference of the disk 15 should have a circumferential speed of not more than 15 m/s and the inner vertical arms should have a circumferential speed of not more than 5 m/s.

If the used sand is rubbed in dry condition in the device according to the invention, the abraded clay particles support the cleaning process. These abraded clay particles must however be removed from the receptacle 1 from time to time. For this purpose a nozzle bottom 7 is provided in the receptacle 1, which subdivides the receptacle 1 into a sand cleaning chamber located above the nozzle bottom and an air chamber located below the nozzle bottom. A plurality of nozzles 6 are provided in the nozzle bottom 7. These nozzles 6 are designed in such fashion that they are not clogged by sand. Only two nozzles 6 are drawn in the nozzle bottom 7 in the represented examples of embodiment. The number of nozzles depends on the operational requirements. A feed means 8 for compressed air opens in the air chamber of the receptacle 1, through which compressed air is introduced into the air chamber. A discharge means 9 for sand and the clay particles (dust) resulting during the cleaning process is provided in the upper area of the receptacle 1. A filter means (not shown) is connected to the discharge means 9. If compressed air is supplied to the receptacle 1 via the compressed air feed means 8, which enters into the sand cleaning chamber of the receptacle 1 through the nozzles 6, a fluidized bed is formed in the interior of the sand cleaning chamber, which aerates the sand batch and discharges the dust particles through the discharge means 9.

According to a preferred operating mode of the device according to the invention, air is continuously blown into the sand cleaning chamber through the nozzles 6 during its operation. Due to such a continuous blowing of air into the sand cleaning chamber its sand filling is changed to a fluidized bed, whereby especially advantageous reclaiming results are obtained. The air speed is selected in such fashion as a function of the grain size that only dust particles, but no sand is discharged through the means 9.

If the used sand is rubbed in dry condition, the quartz grain is imparted a slightly roughened surface.

If an especially smooth quartz grain surface is desired in the reclaimed sand, the sand can be moistened by a moisture supply 10 according to a preferred embodiment of the invention. This means 10 opens in the interior of the sand cleaning chamber of the housing 1. Due to the addition of humidity, an approx. 10% humidity of the sand is brought about and the sand is treated in this condition. The heat originating from the preceding thermal treatment (200° to 300° C.) of the sand and the friction heat originating from the mechanical cleaning of the sand cause a drying of the sand, because water is evaporated. This water can be replaced again. The drying process of the sand can be accelerated by the fact that hot air from the thermal regeneration step is introduced into the receptacle 1.

Since it is occasionally desired to adjust the pH value of the reclaimed sand, acid- or alkali-containing water can be introduced into the receptacle 1 according to a further preferred embodiment of the invention.

Both in the dry working method and in the moist working method the process according to the invention is also suited to reclaim water-glass-bonded or water-glass-ester-bonded used sands to new sand quality. It is understood that in the case of water-glass-bonded sands the used sands need not be pretreated at temperatures of up to 800° C. If there are still dust particles in the reclaimed sand the reclaim can fundamentally be post-treated e.g. by means of separation in the separator or in the fluidized bed.

Some operating results are indicated in the following which were obtained when using the cleaning device according to the invention for reclaiming used foundry sands:

1a) Clay-bonded used foundry sands were reclaimed, these used sands having first been subjected to a thermal treatment to remove organic-carbon-containing substances from the sand grains. After the thermal treatment the sand material was batchwise cleaned by means of the cleaning device according to the invention (fluidized bed cleaner). The resultant reclaimed sand (reclaim) was used for cold box systems, 25% new sand having been added to make up for the amount of carbon, bentonite and dust lost during reclaiming. After a storage time of the cores of 24 hours a flexural strength of 90%, based on 100% new sand, was achieved.

When using reclaims (75% reclaim+25% new sand) a flexural strength increased by approx. 7%, based on 100% new sand results in the case of a storage time of the cores ranging from 5 to 30 minutes.

1b) Clay-bonded used sands were introduced into the device according to the invention (fluidized bed cleaner) without a preceding thermal treatment. After a treatment of 15 minutes a reduction of the loss at red heat from 4.5% to 1.3% was achieved. However, this sand had been previously predried in the fluidized bed cleaning device according to the invention. The obtained reclaim proved to be suited for core production if 50% new sand were added to 50% reclaim.

2) Used alphaset sands were dried in the cleaning device (fluidized bed cleaner) according to the invention and treated for about 9 minutes. Due to this a reduction of the loss at red heat from 3 to 1.8% was achieved. In the case of the use of 70% reclaim and 30% new sand flexural strength were ascertained after a 24-hour storage time of the cores which were by about 12% higher than in the case of 100% new sand. The final strengths decrease again with higher shares of reclaims.

If nothing else is indicated the treatment times of the used sands were 10 minutes as a maximum in the fluidized bed cleaner according to the invention.

The device according to the invention need not be used solely for reclaiming used foundry sands, but also for the precleaning of used sands. Clay-bonded used sands can be precleaned by means of the fluidized bed cleaner according to the invention and in particular dried by blowing hot air into the device according to the invention.

Used alphaset/betaset sands and used $CO_2$ sands do not require any thermal pretreatment at temperatures of 500° to 900° C. The two last-mentioned used sands can be reclaimed with the fluidized bed cleaner according to the invention by supplying hot air to the cleaning device. It is necessary to heat the used sands to about 200° C. The required hot air is advantageously obtained from means which serve for the thermal treatment of clay-bonded used sands at 500° C. to 900° C. The friction heat occurring in the treatment of the used sands in the fluidized bed cleaner according to the invention contributes to achieving these temperatures in the range of about 200° C. In used alphaset/betaset sands and used $CO_2$sands the adhering impurities (plastic/resin residues) disintegrate already at temperatures of about 200° C.

The chemical treatment which is typically used for the used alphaset/betaset sands in the prior art lead to a shifting of their pH values to the strongly basic, which is extremely unfavorable. This disadvantage is overcome by means of the invention.

Figure 3:
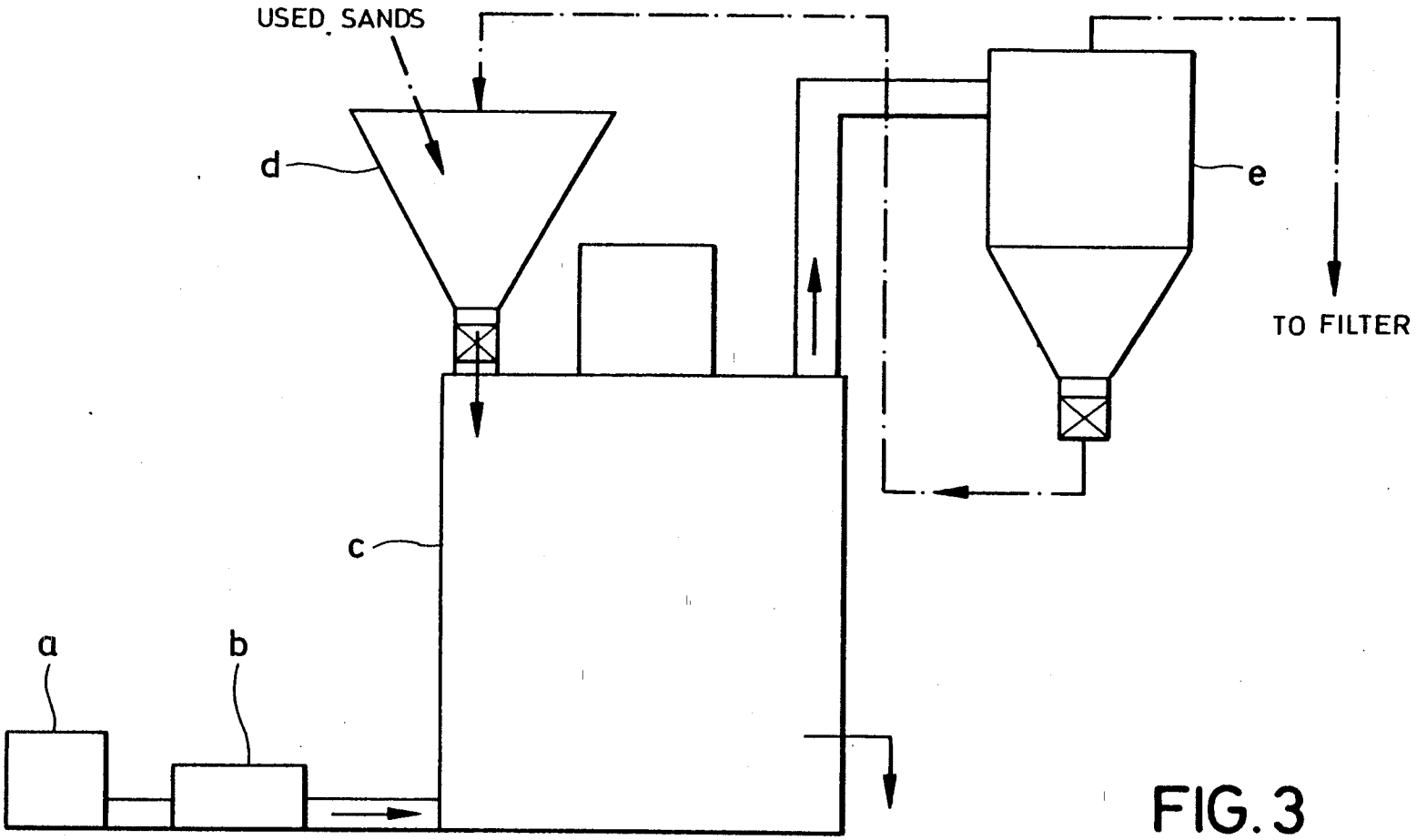

FIG. 3 illustrates schematically the reclaiming of used alphaset/betaset sands and of used $CO_2$ sands and the precleaning of clay-bonded used sands by means of the fluidized bed cleaner according to the invention. As is revaled by FIG. 3 the used sands are batch-wise introduced into the fluidized bed cleaner c via a metering receptacle d. Air heated to about 200° C. is introduced into the fluidized bed cleaner c by means of a fan a and an air heater b. The means for forming a fluidized bed and the rotating friction elements are not represented.

The substances removed from the used sands in the fluidized bed cleaner c are supplied to a cyclone e.

Figure 4:
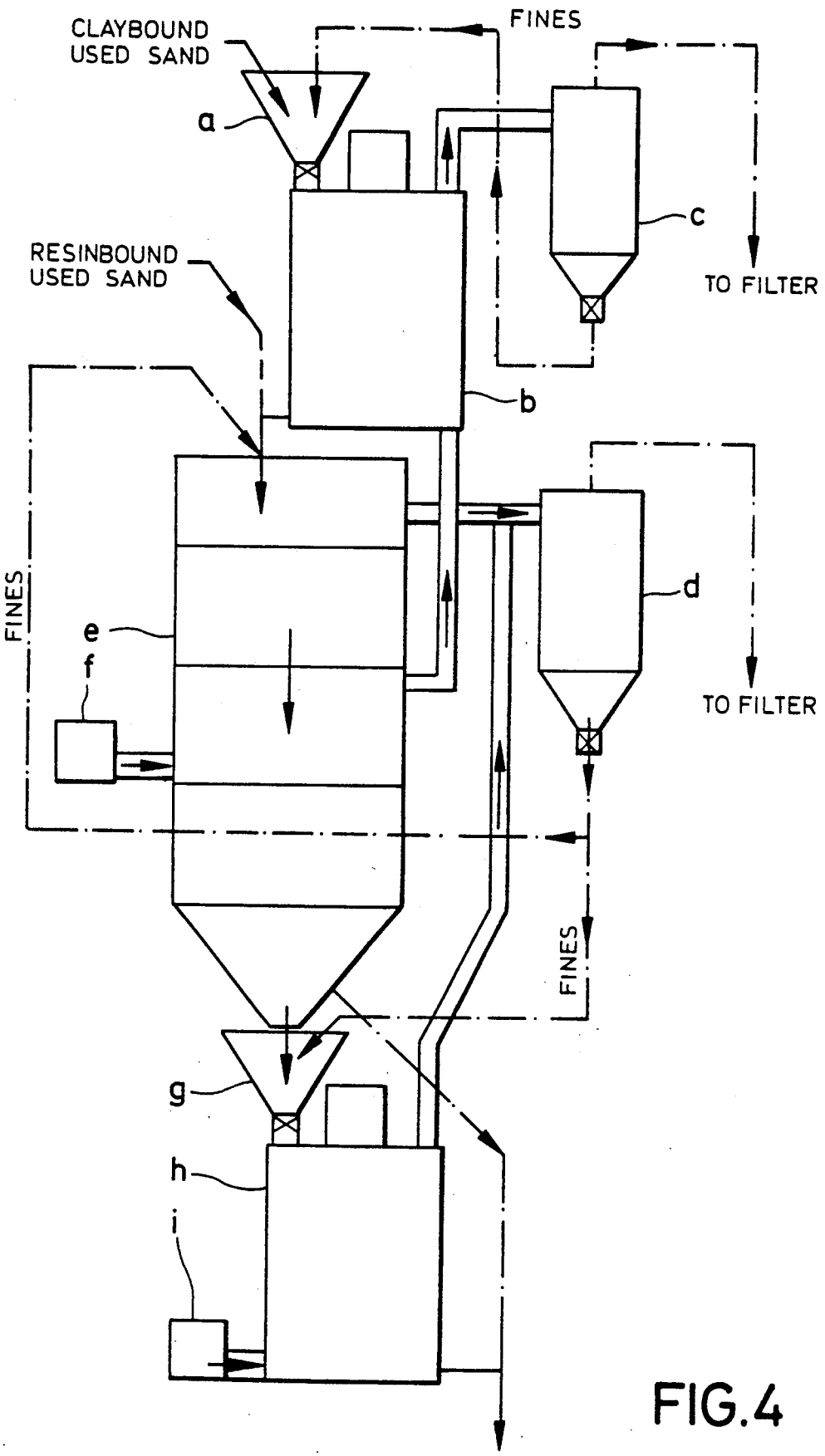

FIG. 4 shows schematically the reclaiming of used foundry sands with organic and inorganic impurities. In FIG. 4 a metering receptacle is designated with a, a fluidized bed cleaner is designated with b, which is used as predrier and precleaner; a first cyclone is designated with c; a second cyclone is designated with d, a unit for the thermal treatment (500° to 900° C.) of the used sands is designated with e, a fan is designated with f, a metering receptacle is designated with g, a fluidized bed cleaner is designated with h and a fan is designated with j.

Used sands containing inorganic impurities (clay-bonded used sands) are introduced into the fluidized bed cleaner b by means of the metering receptacle a. There they are acted upon by hot air from the unit 5 for the thermal sand reclaiming. The pretreated used sand containing inorganic impurities gets from the pretreatment device (fluidized bed cleaner according to the invention) b into the thermal reclaiming unit e. Used sands containing organic impurities are directly introduced into the same. After the carrying out of the thermal treatment (500° to 900° C.) the thermally treated old sands get into the metering receptacle g of the fluidized bed cleaner h, in which the mechanical cleaning according to the invention is carried out.

As is revealed by FIG. 4 two such devices according to the invention are used in the application possibilities of the fluidized bed cleaner according to the invention, which is illustrated there, namely 1) the cleaning device b as sand predrier and at the same time as fluidized bed precleaner and
2) the device h according to the invention, in which the final mechanical sand cleaning is carried out.

The invention is not restricted to the represented and described embodiments.

I claim:

1. Apparatus for mechanical cleaning of used foundry sands, comprising (a) a cylindrical receptable (1);

(b) divider means (7) arranged within said receptacle for dividing said receptacle into a cleaning chamber and an air supply chamber, said cleaning chamber including an inlet opening (3) for depositing used foundry sands into said receptacle cleaning chamber and an outlet opening (4) for discharging clean sand from said receptacle cleaning chamber;

(c) said divider means containing a plurality of nozzles (6) for supplying air from said air supply chamber to said cleaning chamber to create a fluidized bed within said cleaning chamber; and (d) a plurality of friction members formed of a wear-resistant material arranged within said cleaning chamber, said friction members being driven for rotation through the dirty foundry sands, whereby the friction generated by said rotation friction members abrasively cleans the sands.

2. Apparatus as defined in claim 1, and further comprising at least one rotating shaft (5) arranged in said receptacle cleaning chamber and having a vertical axis of rotation, said friction elements comprising horizontal arms connected with said shaft.

3. Apparatus as defined in 2, wherein a plurality of horizontal arms are provided in vertically spaced layers.

4. Apparatus as defined in claim 3, wherein said air supply chamber includes an inlet opening (8) for supplying compressed air to said air supply chamber, and wherein said cleaning chamber includes an exhaust outlet opening (9) for removing air and residue in the form of dust particles removed from the foundry sands from said cleaning chamber.

5. Apparatus as defined in claim 1, and further comprising means (10) for supplying moisture to said cleaning chamber.

6. Apparatus as defined in claim 1, and further comprising at least one rotating horizontal disk (15) arranged in said receptacle cleaning chamber and having a vertical axis of rotation, said friction elements comprising vertical arms depending from said disk.

* * * * *